United States Patent [19]

Compton

[11] 4,084,597

[45] Apr. 18, 1978

[54] FISH HOUSE

[76] Inventor: Richard B. Compton, Rte. 3, E. River Dr., Cambridge, Minn. 55008

[21] Appl. No.: 733,318

[22] Filed: Oct. 18, 1976

[51] Int. Cl.[2] ..... A45F 1/16

[52] U.S. Cl. ..... 135/1 R; 135/DIG. 7

[58] Field of Search ..... 135/1 R, DIG. 7

[56] References Cited

U.S. PATENT DOCUMENTS

| | | | |
|---|---|---|---|
| 2,891,562 | 6/1959 | Kruczynski | 135/1 R |
| 3,352,313 | 11/1967 | Kroening | 135/1 R |
| 3,826,270 | 7/1974 | Hentges | 135/1 R |
| 3,971,395 | 7/1976 | Lipinski | 135/1 R |

*Primary Examiner*—Werner H. Schroeder
*Assistant Examiner*—Conrad L. Berman
*Attorney, Agent, or Firm*—Dugger, Johnson & Westman

[57] ABSTRACT

A collapsible fish house that includes a base having a floor, interior walls inclined upwardly and outwardly of the floor, a perimetric top flange joined to the interior walls, exterior walls extending downwardly and outwardly of the top flange, and a horizontal perimetric flange joined to the lower edges of the exterior walls; a roof having a top wall provided with longitudinal ribs, and of a size and shape to overlay the top flange, roof walls sloped downwardly and outwardly of the roof top wall, and a perimetric portion joined to the lower edges of the last mentioned roof walls that in a fish house collapsed condition seats on the horizontal flange; collapsible walls made of, for example, canvas, having upper edges joined to the roof, lower edges joined to the top flange, and a closable entry; and telescopic poles having lower ends removably mounted by the base exterior of the canvas and upper ends removably mounted in holes in the roof to support the roof in an elevated condition relative the base. The floor is provided with depressed corner portions for having fish holes cut therethrough, and ridges that in conjunction with one of the interior walls surrounds the floor portion on which the stove is to be located.

1 Claim, 5 Drawing Figures

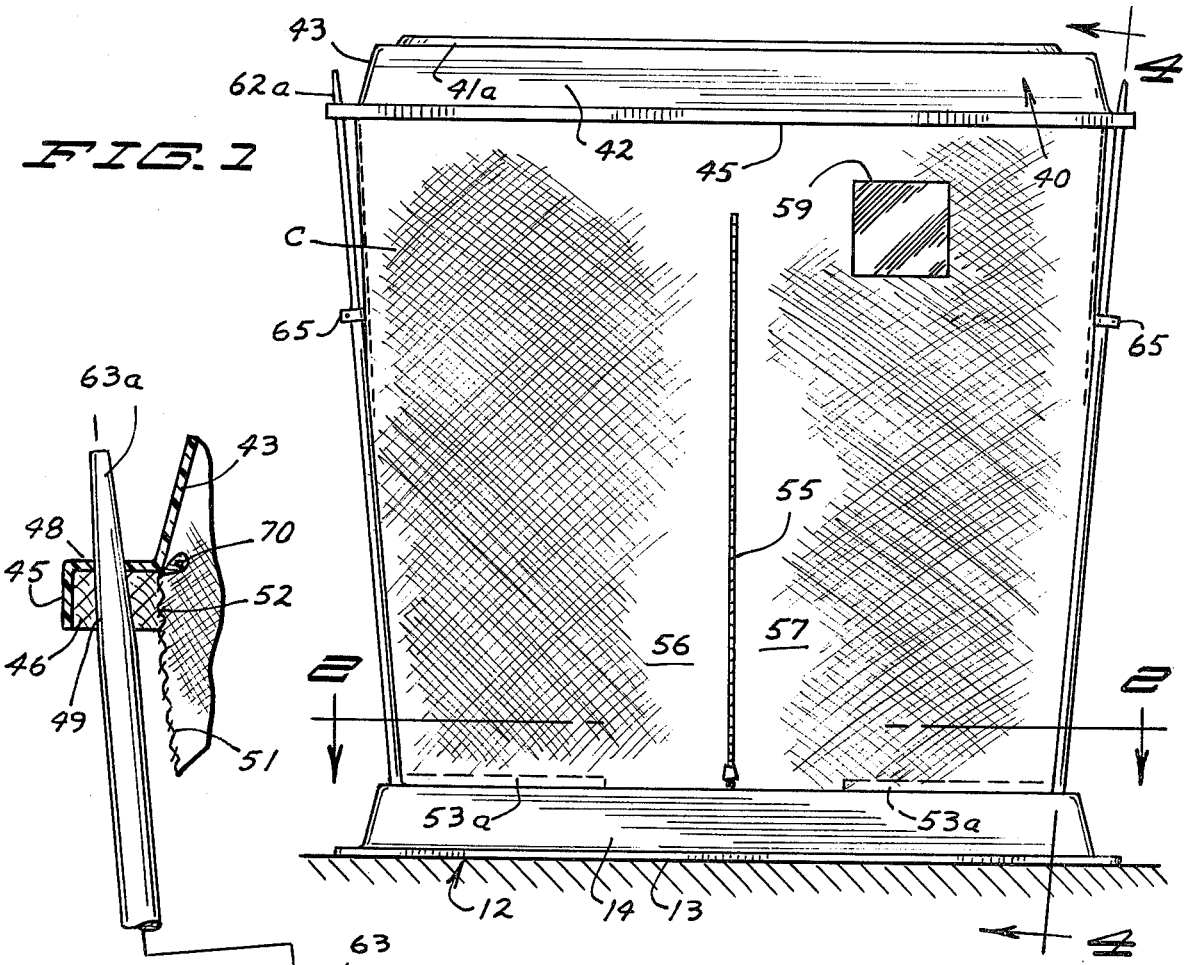
FIG. 1
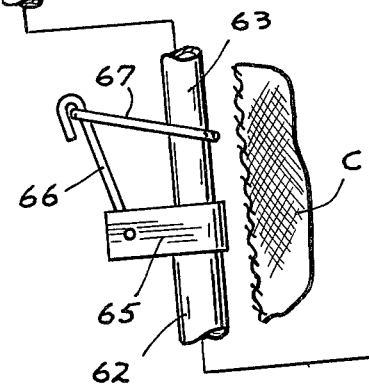
FIG. 4
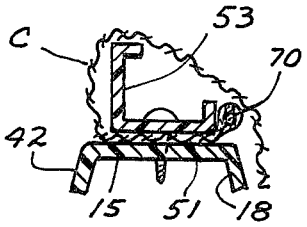
FIG. 5
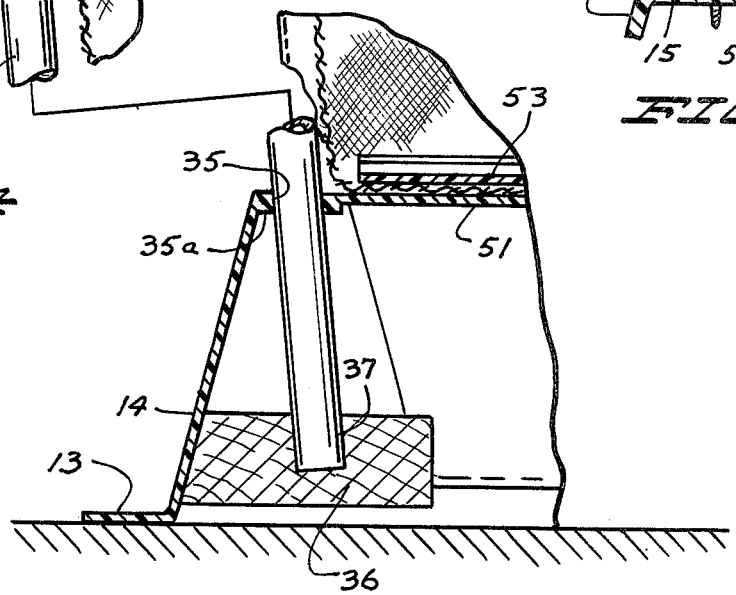

FIG. 2
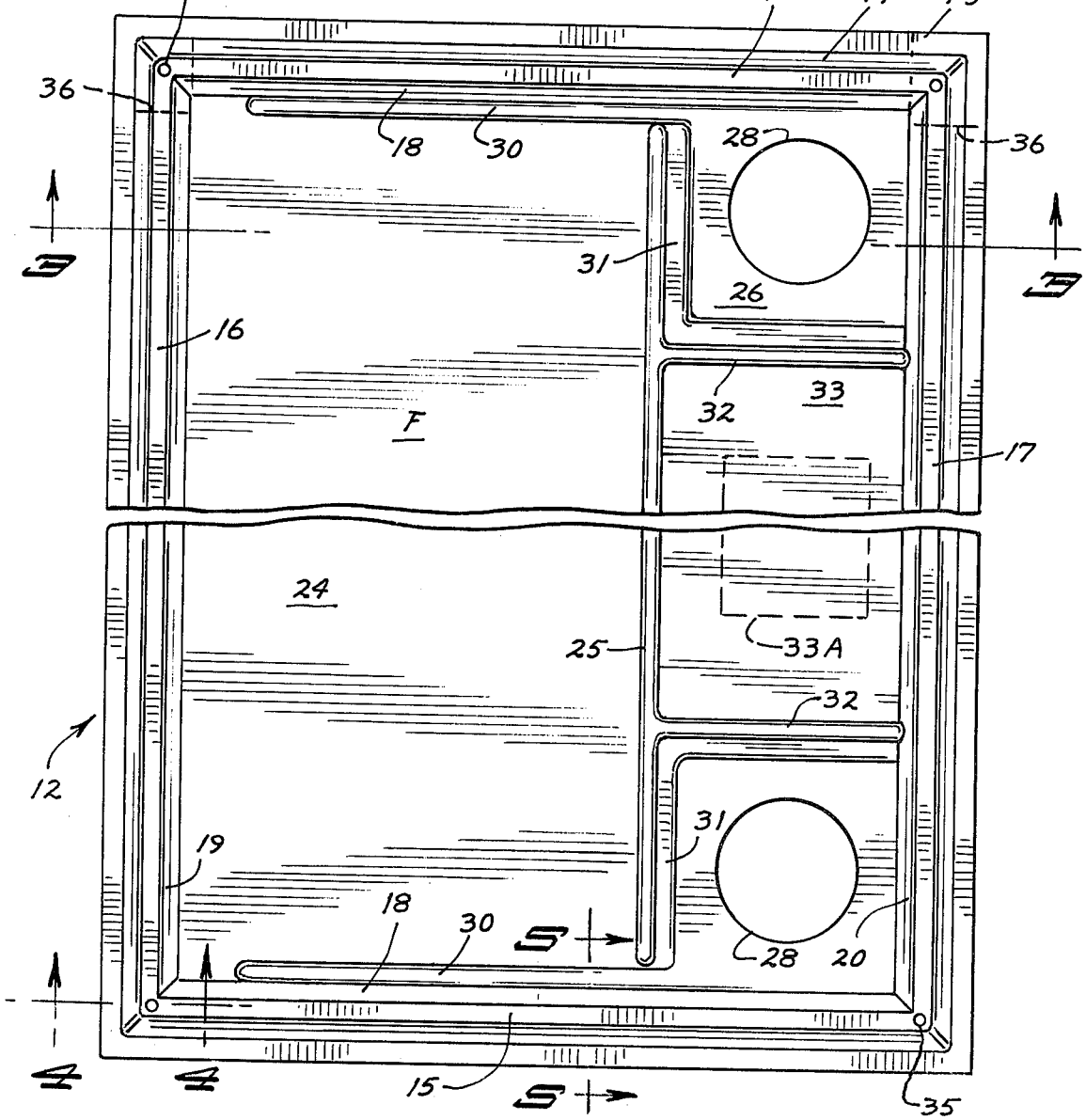
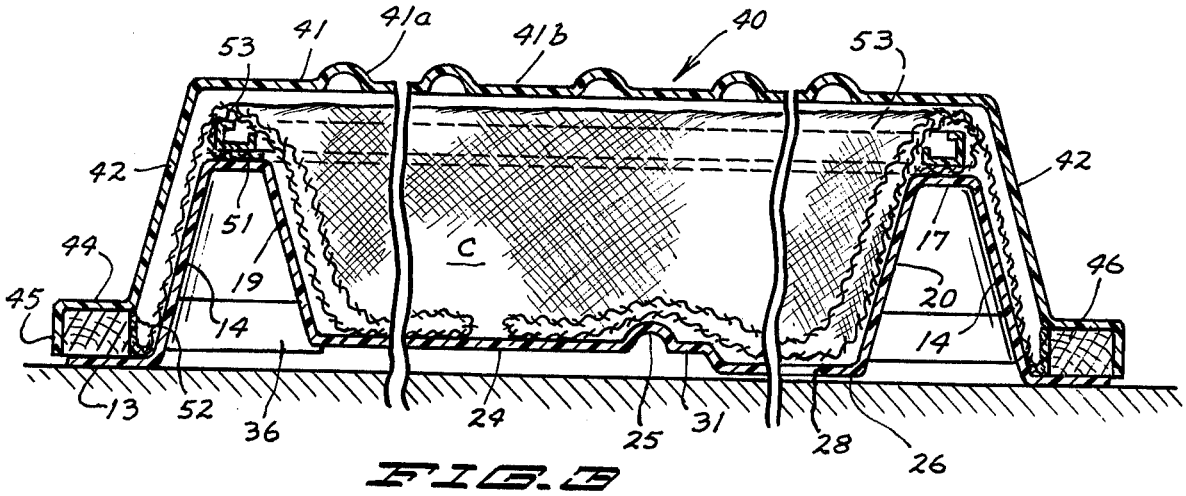
FIG. 3

FISH HOUSE

BACKGROUND OF THE INVENTION

A collapsible fish house.

At least in the State of Minnesota, there is a requirement that all fish houses for ice fishing be removed from the ice prior to a certain date every year, and such presents a problem in removal, particularly when non-collapsible fish houses are used, or are of relatively heavy construction. Additionally, prior art portable fish houses of a reasonable size for at least two occupants do not have the desired combination of easy storage, readily transportability, and sturdiness of construction features that are desired. In order to overcome problems such as the above, as well as others, this invention has been made.

SUMMARY OF THE INVENTION

A fish house that includes a base, a roof, the base and roof being sufficiently rigid to retain a preselected shape during normal use, removably mounted poles for supporting the roof in an elevated position of use relative the base, and nonself-supporting (readily collapsible) material attached to each of the base and roof to provide walls and an openable entry enclosing an occupant space between the roof and base when the roof is in its elevated position of use.

One of the objects of this invention is to provide a new and novel fish house that in a collapsed condition is easily transported and stored. Another object of this invention is to provide a fish house having new and novel nestable roof and base. An additional object of this invention is to provide a fish house that incorporates new and novel safety features in the floor thereof. Another object of this invention is to provide a collapsible fish house having a new and novel roof of a construction for being pulled over ice or snow in engagement therewith. A further object of this invention is to provide a new and novel fish house that can be easily moved as a portable fish house and have the stability of a permanent fish house.

BRIEF DESCRIPTION OF THE DRAWINGS

FIG. 1 is a front view of the fish house of this invention in an elevated position for occupant use;

FIG. 2 is a fragmentary plan view of the base of the fish house of this invention, said view being generally taken along the line and in the direction of the arrows 2—2 of FIG. 1, and in dotted line showing a representation of a stove or a position to be occupied by a stove;

FIG. 3 is a transverse cross-sectional view showing the fish house in a collapsed nested condition, said view being generally taken along the line and in the direction of the arrows 3—3 of FIG. 2;

FIG. 4 is a fragmentary cross-sectional view generally taken along the line and in the direction of the arrows 4—4 of FIG. 2 to illustrate the mounting of one of the poles for supporting the roof in an elevated position relative the base; and FIG. 5 is a fragmentary cross-sectional view generally taken along the line and in the direction of the arrows 5—5 of FIG. 2 to more clearly show the mounting of the canvas material on the base.

Referring now to the drawings, the fish house of this invention includes a rectangular base, generally designated 12, having a generally horizontal perimetric flange 13 that is joined to the lower edge of an exterior wall 14 to extend upwardly thereof. The wall 14 is of a hollow quadra-sided truncated pyramid shape that extends inwardly and upwardly relative the perimetric flange. The angle of inclination of the wall 14 is such to extend horizontally in predominantly a vertical direction. The upper edge of the wall 14 is joined to the side top walls 15, front top wall 16 and rear top wall 17 which are located in a common horizontal plane and are joined to one another to provide a top perimetric flange surrounding a rectangular opening. The inner edges of the top walls 15–17 are respectively joined to side, front and rear interior walls 18, 19 and 20 respectively that slope horizontally inwardly and predominantly downwardly of the respective top wall. The lower edges of the walls 18-20 are joined to the adjacent edges of the floor F.

The floor includes a main floor portion 24 that along its one edge is joined to the lower edge of the wall 19 and along an opposite edge is joined to a longitudinally extending ridge 25 that extends to a higher elevation than the main floor section 24. Also the floor includes generally rectangular depressed corner portions 26 that are joined to the lower edges of wall 20, one corner portion having an edge joined to side wall 18 and the opposite having an edge joined to the lower edge of the other side wall. A hole 28 may be cut in each of the corner portions. Longitudinally intermediate to corner portions 26 there is provided a generally rectangular portion 33 that is provided for supporting a stove (represented by dotted line box 33*a* in FIG. 2) portion 33 being at the same elevation as the main floor portion 24. On one side of the stove floor portion 33 there is provided a transverse ridge 32 that extends between ridge 25 and the wall 20 while on the opposite side of portion 33 there is provided a second transverse ridge 32. The ridges 32 extend to the same elevation as the ridge 25 and in conjunction with the ridge 25 and part of the wall 20 provide a raised dam surrounding floor portion 33 to contain liquid or fuel that is spilled when using the stove in the fish house. This provides a safety feature.

The floor also includes a transversely extending trough 30 on either side thereof that extends substantially the entire width of the main floor section 24, extends between the adjacent end of the ridge 25 and the adjacent side wall and opens to the adjacent corner portion 26. The bottoms of each of the troughs is at substantially the same elevation as the respective corner portion. By providing the troughs along the main floor portion liquid thereon can flow therealong to the corner portions and flow through the hole in the corner portions and onto the ice or hole in the ice. Located between the adjacent parts of ridge 25, ridge 32 and the respective corner portion 26 is a generally L-shaped floor portion 31 that is at the same elevation as floor portions 24 and 33, there being a floor portion sloping downwardly from the respective L portion to the adjacent corner portion such as in part indicated in FIG. 3. Corner portions 36 being depressed and the provision of ridges 32 help minimize the amount of water getting onto floor portion 24 while ice fishing.

At the juncture of each of the adjacent top walls 15–17, there is provided a pole aperture 35 that opens to an aperture 37 in a block 36 that is below the top flange 16 and suitable secured to either or both of the base exterior walls and interior walls, for example, molded for fiber glassed in place. Advantageously each block 36 may be wood, and for purposes of minimizing weight each block is of horizontal dimensions many times smaller than the width and transverse dimensions of the base. Also, advantageously, the top walls may be provided with integrally formed bosses 35A through which apertures 35 extend to reinforce the top walls at the apertures.

A roof, generally designated 40, includes a top wall 41 having a plurality of longitudinally extending ribs 41*a* that extend substantially the entire length thereof, and in a position of occupant use extend to a higher elevation than the generally planar roof portions 41*b* that extend transversely between the ribs and between the ribs and the inclined side walls 43 and inclined front and rear walls 42 of the roof. The ribs 41A provide runners when the roof is overturned and pushed or pulled along the snow or ice.

The walls 42 and 43 extend downwardly and outwardly from the roof top wall at about the same angles the adjacent parts of the exterior wall 14 of the base extends downwardly from the top walls of the base, the vertical dimension of the walls 42, 43 being substantially the same as that of the exterior walls. Joined to the lower edges of the walls 42, 43 is a lower horizontal perimetric flange 44 that extends outwardly thereof, the outer peripheral edge of the flange 44 being joined to the upper edge of a vertical perimetric flange 45. An open rectangular frame 46 is secured to the adjacent parts of flanges 44, 45 to underlie flange 44 and extend inwardly of flange 45. Flange 45 and frame 46 are of dimensions such that both flange 45 and frame 46 will abut against flange 13 when the fish house is in its collapsed condition, the height of frame 46 being sufficient to space the roof top wall from the base top walls a distance sufficient for purposes set forth hereinafter. At this time it is to be noted that the roof top wall is of a size and shape to overlay the base top walls and extend a distance horizontally outwardly of each of the base top walls whereby the roof inclined walls are horizontally spaced from the base exterior wall such as illustrated in FIG. 3 when the frame 46 abuts against flange 13. The maximum length and width dimension of the base top frame are less than the corresponding dimensions of the rectangular opening enclosed by frame 46. That is, the base and roof are of a shape that in a fish house collapsed condition, the base can be nested in the roof.

Adjacent each corner of the frame 46 and the flange 44, the frame and flange areprovided with pole apertures 49, 48 respectively to have the upper frusto-conical end portions 63A of poles 63 at the respective corners slidably extended therethrough to supportingly engage flange 46. Each pole 63 is telescopically extended into a lower pole 62 which in turn has its lower end removably positioned in the apertures 35, 37 of the vertically adjacent corner of the base. The roof and base apertures are suitably inclined so that the poles will be inclined upwardly and outwardly relative the base top walls in view of the spacing of the roof apertures being greater than the corresponding spacing of the base pole apertures. The upper end of each lower pole 62 mounts a bracket 65 which in turn pivotally mounts a hook 66. The hook 66 is extended through the aperture at one end of the clip 67, the opposite end of the clip having a pole 63 extended therethrough. Members 65–67 are of a conventional construction for retaining the telescopic poles in selected adjusted telescoped positions, and permitting the extension of the upper pole into the lower pole being selectively adjusted.

To form the walls extending between the roof and the base when the roof is supported in its elevated occupant use position, there is provided non-self-supporting (collapsible) material C of fire-retardant treated waterproof canvas fabric, nylon, or other suitable material used for making collapsible tents. The upper edge portions 52 of the material C are secured to the frame 46 while the lower edges 51 of the material are secured to the top walls of the base by being extended between angle irons, channels or bars 53 and the top walls to, in conjunction with the roof and base, enclose an occupant chamber. It is to be noted that the bars 53 terminate short of the apertures 35 such that the bars and canvas do not preclude the poles being extended through the apertures 35. Further, with reference to the front part of the base, the bars include bar portions 53*a* that have adjacent ends substantially spaced from one another (see FIG. 1). Horizontally between bar portions 53*a*, the material C is provided with a zipper 55 for providing separating material flap portions 56 and 57 respectively. Thus, when the zipper is in a non-zipped condition, the flaps 56 and 57 between the edges of the zipper to the adjacent ends of the bars 53*a* may be spread apart to provide an entry into the interior of the fish house. Further, one or more of the walls provided by the material C may be provided with a plastic window 59. The lower end portion of the material C may be provided with a hem through which there is extended a draw cord 70 with the draw cord located inwardly of the channels 53. The draw cord can be drawn tight to retain the hem inwardly of the channels, and screws threaded into the base to hold the channels on the base top wall. To preclude interfering with the opening of flaps 56, 57, the lower draw cord 70 is not tied, or else it is terminated at adjacent flap edges. Also a hem and draw cord 70 may be provided on the upper edge portion 52.

Assuming the fish house is in its occupant use condition as illustrated in FIG. 1, when it is desired to take the fish house off the lake, the pole securing members 65, 67 may be operated to permit pole 63 further telescoping into pole 62 and thus the pole end portions 63*a* drawn through apertures 48 and 49. At this time, the poles 62 may be withdrawn from apertures 35 and 37. Now, as the roof is lowered, the material C is tucked in toward the horizontally intermediate part of the base such that it will be reversely folded upon itself as in part indicated in FIG. 3. Prior to the complete lowering of the roof, the telescopically retracted poles 62, 63 may be positioned between the reversely bent parts of the folded material C to be located above the base floor for purposes of storage. After the roof has been lowered to its nested condition that frame 46 abuts against flange 13 the fish house may be overturned so that the ridges or ribs 41*a* are on the snow. The base top flange and the roof are sufficiently spaced in the nested condition to permit the material C being extended therebetween. Advantageously, there may be provided additional openings (not shown) through flanges 13, 44 and frame 46 for having nuts and bolts (not shown) for clamping flange 44 to flange 13. Now the fish house may be pulled along the snow or ice and thence positioned on a car roof or other structure for transporting the fish house to its next destination.

In the event the stove is of a type that burns combustible fuel, then a suitable opening may be provided in the material C for exhausting the combustion gases together with a suitable heat shield provided around the opening to preclude overheating of the material C.

Advantageously, the roof and base other than frame 46 and blocks 36 are made of material such as fiberglass or other type plastic of sufficient rigidity to be self-supporting (retain the shape in which they are formed) in the condition formed during normal usage, and each if formed as a one-piece integral unit.

Even though it has been set forth that portion 33 is adapted to have a stove located thereon, the fish hole can be cut in floor portion 33 and a stove, if used, can be positioned on one of floor portions 26. Further vent apertures can be provided in each of roof walls 43.

As an example of the invention but not otherwise as a limitation thereon, the fish house in an occupant use condition may be approximately 4 feet wide by 6 feet long with the distance between the floor and the top wall of the roof being about six and a half feet. Further, the horizontal spacing of the ridge 25 from wall 20 may be approximately a third of the distance from wall 20 to wall 19 while the spacing of each rib 32 from the adjacent side wall of the base may be approximately a fourth of the distance to the opposite side wall of the base. The height of each of the base and floor may be about eight to ten inches. Thus, the fish house in a collapsed condition occupies a relatively small amount of space, but in the roof elevated condition of use provides adequate room to be occupied by at least two grown adults while fishing.

What is claimed is:

1. A fish house comprising a base having a floor and walls joined to the floor to extend over the floor in surrounding relationship thereto, a roof of a size and shape to have the base nestingly extended thereinto, the roof being of sufficient rigidity to normally maintain a preselected shape, and means extending between the roof and the base to support the roof in an elevated condition relative the base and in conjunction with the roof and base define an openable chamber, the base walls including interior front, rear and side walls joined to said floor to extend upwardly and horizontally outwardly thereof, a top perimetric flange joined to the interior walls to extend outwardly thereof at a substantially higher elevation than the floor, an exterior perimetric wall joined to the top perimetric flange to extend downwardly and outwardly thereof, said exterior wall having a lower edge, and a base perimetric flange joined to the exterior wall lower edge to extend generally horizontally outwardly thereof, the roof including a top roof wall of a size and shape to completely overhang the base top flange, said roof top wall having a peripheral outer edge, a perimetric roof wall having a lower peripheral outer edge and being joined to the roof top wall peripheral outer edge to extend downwardly and outwardly thereof, and a lower perimetric roof portion joined to the perimetric roof wall peripheral edge, each of the base top flange and the roof lower portion being rectangular and defining a rectangular opening, the maximum length and width dimensions of the base top flange being substantially smaller than the corresponding dimensions of the roof lower portion opening, each of the roof lower portion and the base top flange having a plurality of pole openings, and the above mentioned means including a plurality of poles removably mounted in the pole openings for supporting the roof in an elevated condition relative to the base, and collapsible means having a upper peripheral edge attached to the roof lower portion and a lower peripheral edge mounted on the base top flange for acting in cooperation with the roof and base to enclose an occupant chamber, said collapsible means having means forming a closable entry.

* * * * *